US011139154B2

(12) United States Patent
Kodera et al.

(10) Patent No.: US 11,139,154 B2
(45) Date of Patent: Oct. 5, 2021

(54) MALDI MASS SPECTROMETER AND MATRIX OBSERVATION DEVICE

(71) Applicant: Shimadzu Corporation, Kyoto (JP)

(72) Inventors: Kei Kodera, Kyoto (JP); Hideharu Shichi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 80 days.

(21) Appl. No.: 16/266,133

(22) Filed: Feb. 4, 2019

(65) Prior Publication Data

US 2020/0251321 A1 Aug. 6, 2020

(51) Int. Cl.
*H01J 49/00* (2006.01)
*H01J 49/04* (2006.01)
*H01J 49/10* (2006.01)

(52) U.S. Cl.
CPC ..... *H01J 49/0418* (2013.01); *H01J 49/0004* (2013.01); *H01J 49/10* (2013.01)

(58) Field of Classification Search
CPC ..... H01J 49/00; H01J 49/02; H01J 49/0418; H01J 49/164
USPC ..... 250/281, 282, 288
See application file for complete search history.

(56) References Cited

U.S. PATENT DOCUMENTS 5,751,844 A * 5/1998 Bolin ..... G06T 5/40 348/221.1
2005/0045815 A1* 3/2005 Bui ..... H01J 49/0418 250/282
2006/0163492 A1* 7/2006 Mennicken ..... G06K 7/12 250/483.1
2014/0084151 A1* 3/2014 Ferguson ..... H01J 49/0004 250/282
2016/0210613 A1* 7/2016 McGill ..... H04B 5/0031
2019/0122878 A1* 4/2019 Holman ..... H01J 49/0004
2019/0369115 A1* 12/2019 Fukuyama ..... H01J 49/164

FOREIGN PATENT DOCUMENTS

JP 2012-003898 A 1/2012
JP 2012-177689 A 9/2012
JP 2014-212068 A 11/2014

OTHER PUBLICATIONS

Notification of Reasons for Refusal for corresponding Japanese application No. JP 2016-168163 dated Aug. 27, 2019.

* cited by examiner

*Primary Examiner* — Jason L McCormack
(74) *Attorney, Agent, or Firm* — Muir Patent Law, PLLC

(57) ABSTRACT

The invention provides a matrix observation device where a location to be irradiated with a laser beam that provides high efficiency of the ionization can be found from among sample spots arranged on a sample plate. The device is formed of: a stage 31 on which a sample plate 20 on which a sample is to be arranged is to be placed; a light source unit 40 that emits ultraviolet rays for observation with which the sample plate 20 is irradiated; and an image acquisition unit 50 for detecting light from the sample plate 20 so as to create an optical image, and the sample contains a matrix that absorbs the ultraviolet rays for observation.

20 Claims, 5 Drawing Sheets

MALDI MASS SPECTROMETER AND MATRIX OBSERVATION DEVICE

BACKGROUND OF THE INVENTION

1. Field of the Invention

The present invention relates to a matrix assisted laser desorption ionization (MALDI) mass spectrometer where a sample that has been mixed with a matrix is irradiated with a laser beam so as to gasify or ionize the sample, and to a matrix observation device that is used in such a MALDI mass spectrometer.

2. Description of Related Art

Matrix assisted laser desorption ionization (MALDI) is a method where a sample that is gained by mixing a microscopic amount of substance to be analyzed (protein or the like) with a solvent that contains an ionization assisting agent that is referred to as "matrix" such as DHB (2,5-dihydroxybenzolate) or CHCA (alpha-cyano-4-hydroxycinnamate) is irradiated with a laser beam so that part of the matrix that has absorbed the heat from the irradiation with the laser beam is rapidly heated so as to be gasified, and thus, the substance to be analyzed is gasified or ionized.

At the time of analysis in a mass spectrometer that is provided with such a MALDI ion source, a sample is dropped onto the upper surface of the sample plate so as to provide a spot, for example, and the sample is placed within a vacuum chamber after the sample has been dried as a result of the evaporation of the solvent. Then, the analysis is started by starting the operation of the vacuum pump in order to make the inside of the vacuum chamber a vacuum. Typically, a number of samples are arranged in M rows and N columns on the upper surface of the sample plate, and each sample arranged on the sample plate is shifted to a plate that is irradiated with a laser beam by moving the sample plate so that the samples are ionized one after another.

A MALDI-TOFMS is known as an example of a mass spectrometer that is provided with a MALDI ion source, where the generated ions are drawn out by means of an electrical field having a predetermined intensity so as to be introduced into a space where ions travel for mass spectrometry. The speed of each ion that travels through the space depends on the mass-to-charge ratio of the ion in such a manner that the smaller the mass-to-charge ratio is, the greater the velocity of the ion is. Therefore, a variety of ions can be detected by separating them for each mass-to-charge ratio in accordance with the time it takes for the ion to reach the detector.

FIGS. 4 and 5 are diagrams showing examples of the configuration of a conventional MALDI-TOFMS. Here, one direction that is horizontal relative to the ground is the X direction, the direction that is horizontal relative to the ground and perpendicular to the X direction is the Y direction, and the direction that is perpendicular to the X direction and the Y direction (vertical direction) is the Z direction.

A MALDI-TOFMS 201 is provided with: a mass spectrometry unit 10; a sample plate 20; a sample stage 31 on which the sample plate 20 is to be placed; a stage drive unit 32 for moving the sample stage 31; a visible light source unit (light source unit) 240 that emits visible light for observation with which the upper surface of the sample plate 20 is irradiated; an image acquisition device (image acquisition unit) 250 for acquiring an image of the upper surface of the sample plate 20; a laser emitting unit 5 for emitting a laser beam for ionization to the sample; and a computer 260 for controlling the entirety of the MALDI-TOFMS 201.

The mass spectrometry unit 10 is formed of a free flight space 20 through which ions freely travel without undergoing the effects of an electrical field, an ion transporting optical system, a mass spectrometer and an ion detector 11, where a static electromagnetic lens, a multipolar-type high frequency ion guide or the like is used as the ion transporting optical system, and a quadripolar-type analyzer, an ion trap, a flight time-type analyzer, a magnetic field sector type analyzer or the like is used as the mass spectrometer.

In addition, an aperture 3 for shielding the diffused ions and an einzel lens 2, which functions as an ion transporting optical system for transporting ions to the mass spectrometry unit 10, are provided between the below-described sample plate 20 and the mass spectrometry unit 10. Of course, an ion transporting optical system having any type of configuration other than the einzel lens 2 may be used.

Such a mass spectrometry unit 10 allows the ions that have been released from the sample as a result of the irradiation with a laser beam to pass through the aperture 3, the einzel lens 2 and the ion transporting optical system so as to be sent to the mass spectrometer where the ions are separated into various types depending on the mass-to-charge ratio. When the separated ions reach the ion detector 11, the ion detector 11 outputs a sample signal to the computer 260 in accordance with the number of ions that have reached the ion detector 11.

A sample plate 20 is made of a plate body (8 cm×3 cm×0.2 cm, for example) formed of a metal having conductivity. On the upper surface of this plate body, circular wells having a diameter of approximately 3 mm to 5 mm, for example, are created so as to be arranged in M rows by N columns. A sample solution is dripped into these wells and then dried so that pieces of the sample are arranged.

The MALDI-TOFMS 201 is provided with a sample stage 31 on which the above-described sample plate 20 is placed, and a stage drive unit 32 made of a motor and the like. As a result, the computer 260 outputs a drive signal that is required for the stage drive unit 32 from the below-described stage control unit 61*a* so as to move the sample stage 31 in the X direction and Y direction as desired, and thus, the sample plate 20 that is mounted on the sample stage 31 is moved in a desired direction (X, Y directions).

The visible light source unit 240 is provided with a halogen lamp 241 for emitting visible light for observation and a reflection mirror 42. The visible light that has been emitted from the halogen lamp 241 is reflected from the reflection mirror 42, and after that, a predetermined area on the upper surface of the sample plate 20 is irradiated with the visible light.

Here, the "predetermined area" is any area that has been predetermined by the designer or the like, and the area is predetermined in such a manner that a part of a well is not excluded.

The image acquisition device 250 is provided with a visible light camera 251 for acquiring a visible light image (optical image) and a reflection mirror 52. The visible light that has been reflected from the upper surface of the sample plate 20 is reflected from the reflection mirror 52, and after that detected by the visible light camera 251, and as a result, a visible light image, which is an image of the predetermined area on the upper surface of the sample plate 20, is acquired.

The laser emission unit 5 is provided with a reflection mirror 7 and a nitrogen laser 6. Such a laser emission unit 5 allows a laser beam (ultraviolet rays) having a wavelength of 337 nm that has been emitted from the nitrogen laser 6 to be emitted toward the sample on the sample plate 20 via the reflection mirror 7. At this time, the diameter of the spot on the sample that is irradiated with the laser beam is as microscopic as 1 μm to several tens of μm, for example.

The computer 260 is provided with a CPU 261, an input unit 62 and a display unit 63. The functions resulting from the process by the CPU 261 are described by referring to them as units as follows. The CPU 261 has a stage control unit 61*a* for controlling the stage drive unit 32 on the basis of the input signal from the input unit 62, a display control unit 261*b* for controlling the visible light source unit 240, and at the same time taking in the visible light image that has been acquired by the image acquisition device 250 so that the visible light image is displayed on the display unit 63, and an analysis control unit 61*c* for controlling the nitrogen laser 6, and at the same time digitizing the sample signal from the ion detector 11 so that an appropriate data process is carried out.

Though a sample solution is dripped into the circular wells and dried in the above-described MALDI-TOFMS 201, the pieces of the sample are not necessarily arranged in the center of the wells, but rather may be arranged in the locations that are shifted from the center of the wells. Furthermore, though crystals are gained when the sample that is a mixture of a matrix and a substance to be analyzed is dried, a non-uniformed large crystal may be generated or the distribution of the substance to be analyzed is not necessarily uniform. Even if the sample is arranged in the center of a well, the best portion to be measured in the sample (hereinafter, referred to as a "sweet spot") is not necessarily the center of the well.

Therefore, an operator who carries out analysis by using the MALDI mass spectrometer 201 uses the input unit 62 so as to move the sample stage 31 while observing the visible light image displayed on the display unit 63, and thus finds a spot that seems to be optimal for ionization so as to position the spot within the range that is irradiated with the laser beam. Alternatively, the operator may confirm the measurement data through irradiation with a laser beam in order to find the sweet spot.

A MALDI mass spectrometer for identifying an area where a substance to be analyzed exists in the sample from the image that has been taken by using the brightness threshold value and the mass spectral data is also disclosed (see Patent Literature 1). Here, the whereabouts of the light source for acquiring an image is unclear in Patent Literature 1 which naturally do not describe the type of light (wavelength range) for observation or the angle of light for irradiation.

3. Citation List

Patent Literature

Patent Literature 1: Japanese Unexamined Patent Publication 2014-212068

SUMMARY OF THE INVENTION

1. Technical Problem

In the conventional mass spectrometer having a MALDI ion source where an operator observes the visible light image gained by irradiating a sample with visible light in order to determine the spot to be irradiated with a laser beam, such a problem arises that the location exhibiting such characteristics that the state of the matrix seems to be appropriate for ionization and the sweet spot where an intense sample signal is outputted are not necessarily the same.

Though a method for determining the location to be irradiated that is appropriate for ionization by using measurement data or mass spectral data is also possible, it is very troublesome to acquire measurement data or mass spectral data repeatedly in order to determine the location to be irradiated with a laser beam.

2. Solution to Problem

The applicant examined a method for finding the location to be irradiated with a laser beam that makes the ionization highly efficient from among the sample spots that are arranged on the upper surface of the sample plate 20 in the MALDI ion source.

A nitrogen laser or a solid-state laser is widely used as the light source for ionization in MALDI. The laser beam emitted from the nitrogen laser has a wavelength of 337 nm, and a solid-state laser has a wavelength of 355 nm. In addition, it is necessary for the matrix to absorb the energy of the laser beam for the ionization resulting from the irradiation with a laser beam, and therefore, a substance having a light absorbance band (particular wavelength range) in proximity to the same wavelength as that of the laser beam is mixed with the sample as a matrix. Thus, the applicant came up with the idea for a laser beam of which the wavelength is for ionization or light of which the wavelength is close to the wavelength range that is absorbed by the matrix to be emitted when an optical image is acquired, and then the acquired image was observed so as to find that there is a correlation between the distribution state of the matrix (crystal) and the region exhibiting good efficiency in ionization.

That is to say, the matrix observation device according to the present invention is a matrix observation device provided with: a stage on which a sample plate on which a sample is to be arranged is to be mounted; a light source unit for irradiating the above-described sample plate with light for observation; and an image acquisition unit for detecting light from the above-described sample plate so as to form an optical image, where the above-described sample contains a matrix that absorbs light having a particular wavelength range, and the wavelength range of the light that is emitted from the above-described light source unit overlaps the above-described particular wavelength range.

3. Advantageous Effects of the Invention

In the matrix observation device according to the present invention, the wavelength range of the light for observation with which the sample is irradiated overlaps the wavelength range that is absorbed by the matrix (particular wavelength range), and as a result, the matrix absorbs or reflects the light for observation so that the distribution of the matrix (crystal) can be observed precisely in order to determine the location that is appropriate for ionization through MALDI. Here, it is preferable for the wavelength range of the light for observation to be precisely the same as the wavelength range that is absorbed by the matrix. In the case where part of the wavelength range of the light for observation and part of the wavelength range that is absorbed by the matrix overlap, however, a correlation is found between the distribution state of the matrix that is observed in the present invention and the efficiency in ionization, and therefore, the effects of the present invention can be gained.

4. Other Solutions to Problem and Advantageous Effects Thereof

In the invention, the above-described particular wavelength range may be an ultraviolet range or an infrared range.

In addition, in the invention, the above-described light source unit may emit ultraviolet rays or infrared rays in the direction that forms a predetermined angle or a smaller angle relative to the vertical direction, while the above-described image acquisition unit may be an ultraviolet ray camera or an infrared ray camera for detecting the ultraviolet rays or the infrared rays reflected from the upper surface of the above-described sample plate so as to form an optical image.

Here, the "predetermined angle or a smaller angle" is a deep angle that has been predetermined by the designer in such a manner that the ultraviolet rays or the infrared rays reflected from the upper surface of the sample plate enter into the image acquisition unit.

In the matrix observation device according to the present invention, emitted light for irradiation is absorbed in a place where the matrix is distributed, and therefore is observed as a black shadow in the optical image.

Furthermore, in the invention, the above-described light source unit may emit ultraviolet rays or infrared rays in the direction that forms a predetermined angle or a larger angle relative to the vertical direction, while the above-described image acquisition unit may be a visible light camera for detecting visible light that has been emitted from the sample arranged on the upper surface of the above-described sample plate so as to form an optical image.

Here, the "predetermined angle or a larger angle" is a shallow angle that has been predetermined by the designer so that the visible light that has been emitted from the sample arranged on the upper surface of the sample plate enters into the image acquisition unit.

In the matrix observation device according to the present invention, the ultraviolet rays or the infrared rays that have been absorbed by the matrix are emitted as visible light, which makes the place where the matrix is distributed brighter in the optical image.

Moreover, in the invention, the above-described matrix may be a matrix having an absorbance band in an ultraviolet or infrared region, such as DHB or CHCA.

As for DHB in particular, the crystal is not generated uniformly, and therefore, the matrix observation device according to the present invention is particularly effective.

In addition, in the invention, a number of samples may be arranged on the upper surface of the above-described sample plate.

Thus, the MALDI mass spectrometer according to the present invention is provided with: a matrix observation device as that described above; a laser emitting unit for irradiating the above-described sample with a laser beam; and a mass spectrometry unit for carrying out mass spectrometry on the gasified sample or ions that have been emitted from the above-described sample irradiated with the laser beam. In particular, it is preferable for the wavelength range of the light for observation to include the wavelength of the laser beam that is emitted from the laser emitting unit so as to be used for ionization.

DETAILED DESCRIPTION OF EMBODIMENTS

In the following, embodiments of the present invention are described in reference to the drawings. Here, the present invention is not limited to the embodiments described in the following but includes various modifications as long as the gist of the present invention is not deviated from.

1. First Embodiment

Figure 1:
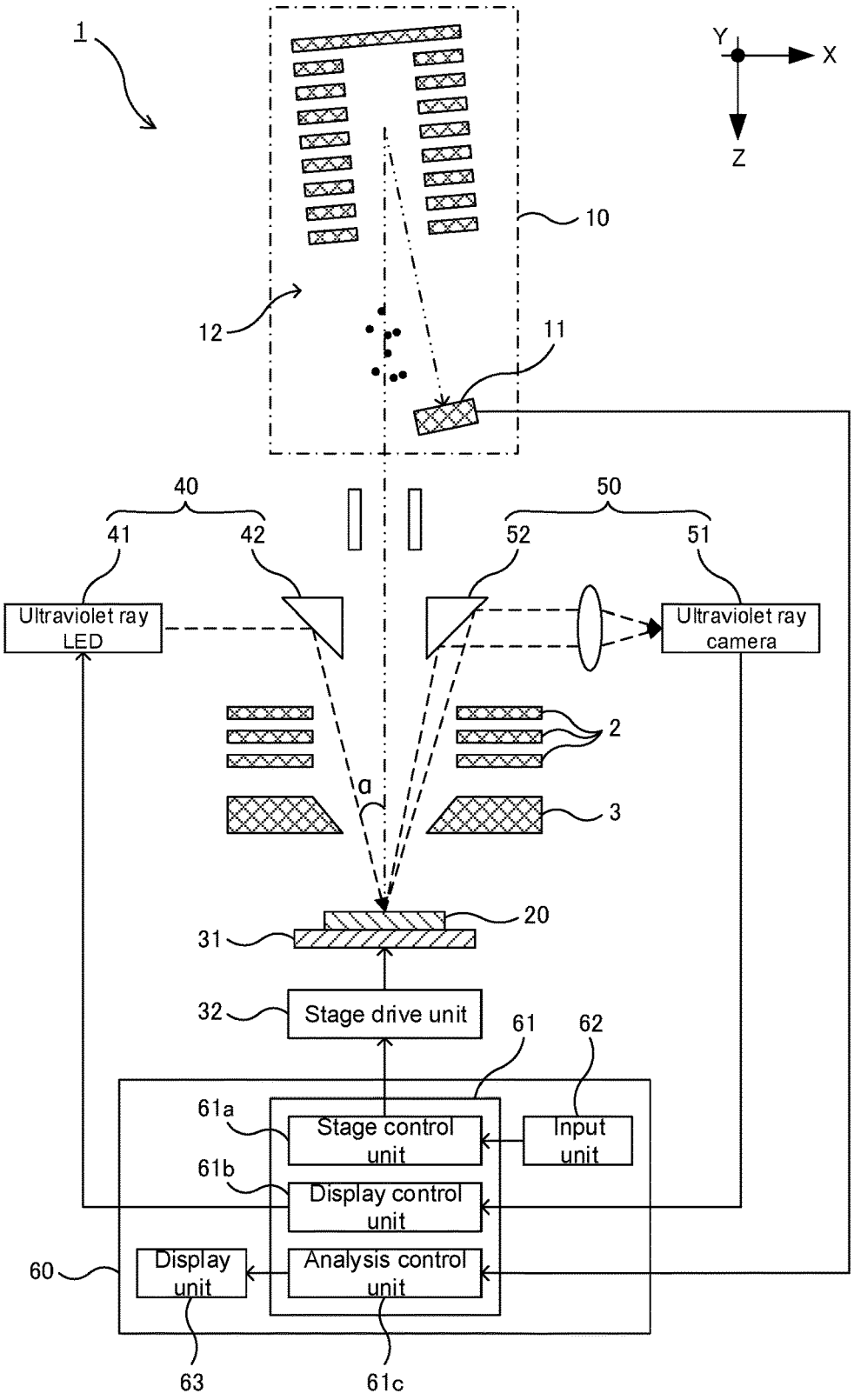
FIG. 1 is a diagram showing a configuration of the first embodiment.
Figure 2:
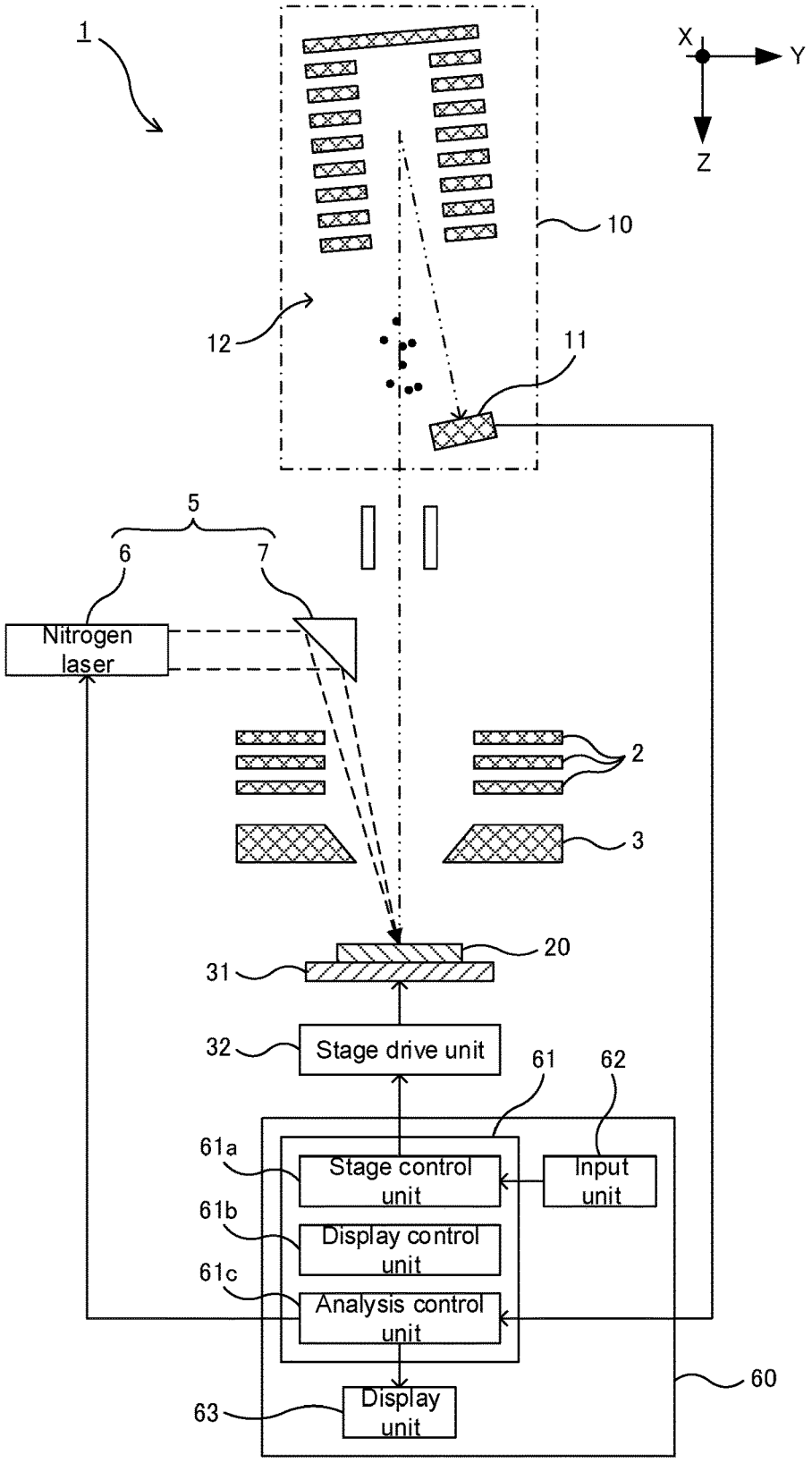
FIG. 2 is a diagram showing another configuration of the first embodiment.

FIGS. 1 and 2 diagrams showing the configurations of the MALDI-TOFMS according to the first embodiment of the present invention. Here, the same symbols are attached to the same components as those in the above-described MALDI-TOFMS 201, and the descriptions thereof are not repeated.

A MALDI-TOFMS 1 is provided with: a mass spectrometry unit 10; a sample plate 20; a sample stage 31 on which the sample plate 20 is to be mounted; a stage drive unit 32 for moving the sample stage 31; an ultraviolet ray source unit (light source unit) 40 for irradiating the upper surface of the sample plate 20 with ultraviolet rays for observation; an image acquisition device (image acquisition unit) 50 for acquiring an image of the upper surface of the sample plate 20; a laser emitting unit 5 for emitting a laser beam for ionization to the sample; and a computer 60 for controlling the entirety of the MALDI-TOFMS 1.

The ultraviolet ray source unit 40 is provided with: an ultraviolet ray LED 41 for emitting ultraviolet rays for observation; and a reflection mirror 42. Thus, the ultraviolet rays emitted from the ultraviolet ray LED 41 are reflected from the reflection mirror 42, and after that, a predetermined range on the upper surface of the sample plate 20 is irradiated with the ultraviolet rays in the direction that forms a set angle $\alpha$ relative to the Z direction (vertical direction).

It is preferable for the wavelength range of the above-described ultraviolet rays for observation emitted from the ultraviolet ray source unit 40 to be a wavelength range that includes the wavelength of 337 nm of the laser beam from the nitrogen laser or the wavelength of 355 nm of the laser beam from the solid-state laser. Alternatively, it is preferable for the wavelength at the center of the above-described ultraviolet rays to be close to the wavelength at the center of the laser beam that is emitted from the laser emitting unit. It is more preferable for the wavelength at the center of the above-described ultraviolet rays to be within +/−20 nm from the wavelength at the center of the laser beam emitted from the laser emitting unit. In addition, it is preferable for the above-described set angle $\alpha$ to be 45° or smaller (predetermined angle or a smaller angle).

The image acquisition device 50 is provided with: an ultraviolet ray camera 51 for acquiring an ultraviolet ray image (optical image); and a reflection mirror 52. Thus, the ultraviolet rays reflected from the upper surface of the sample plate 20 in the direction that forms 45° relative to the upper surface of the sample plate 20 are reflected from the reflection mirror 52, and after that detected by the ultraviolet ray camera 51, and as a result, an ultraviolet ray image, which is an image of a predetermined range on the upper surface of the sample plate 20, is acquired.

The computer 60 is provided with a CPU 61, an input unit 62 and a display unit 63. The functions resulting from the process by the CPU 61 are described by referring to them as units as follows. The CPU 61 has: a stage control unit 61*a* for controlling the stage drive unit 32 on the basis of an input signal from the input unit 62; a display control unit 61*b* for controlling the ultraviolet ray source unit 40 and taking in an ultraviolet ray image that has been acquired by the image acquisition device 50 so as to display the ultraviolet ray image on the display unit 63; and an analysis control unit 61*c* for controlling the nitrogen laser 6 and digitizing a sample signal from the ion detector 11 so as to carry out an appropriate data process.

In the MALDI-TOFMS 1, an operator drips a sample solution gained by mixing DHB or CHCA with a substance to be analyzed into wells on the upper surface of the sample plate 20 and dries the sample solution so as to arrange a sample. Next, the sample plate 20 is placed on the sample stage 31, and after that, the sample stage 31 is moved to find a location that seems to be appropriate for ionization by using the input unit 62 while observing the ultraviolet ray image before the start of the analysis. Thus, the sample is positioned on the upper surface of the sample plate 20 so as to be located within a range irradiated with a laser beam. At this time, ultraviolet rays are absorbed in the location where the matrix is distributed, which is thus observed as a black shadow in the ultraviolet ray image, and therefore, the distribution of the matrix (crystal) can be observed precisely.

2. Second Embodiment

Figure 3:
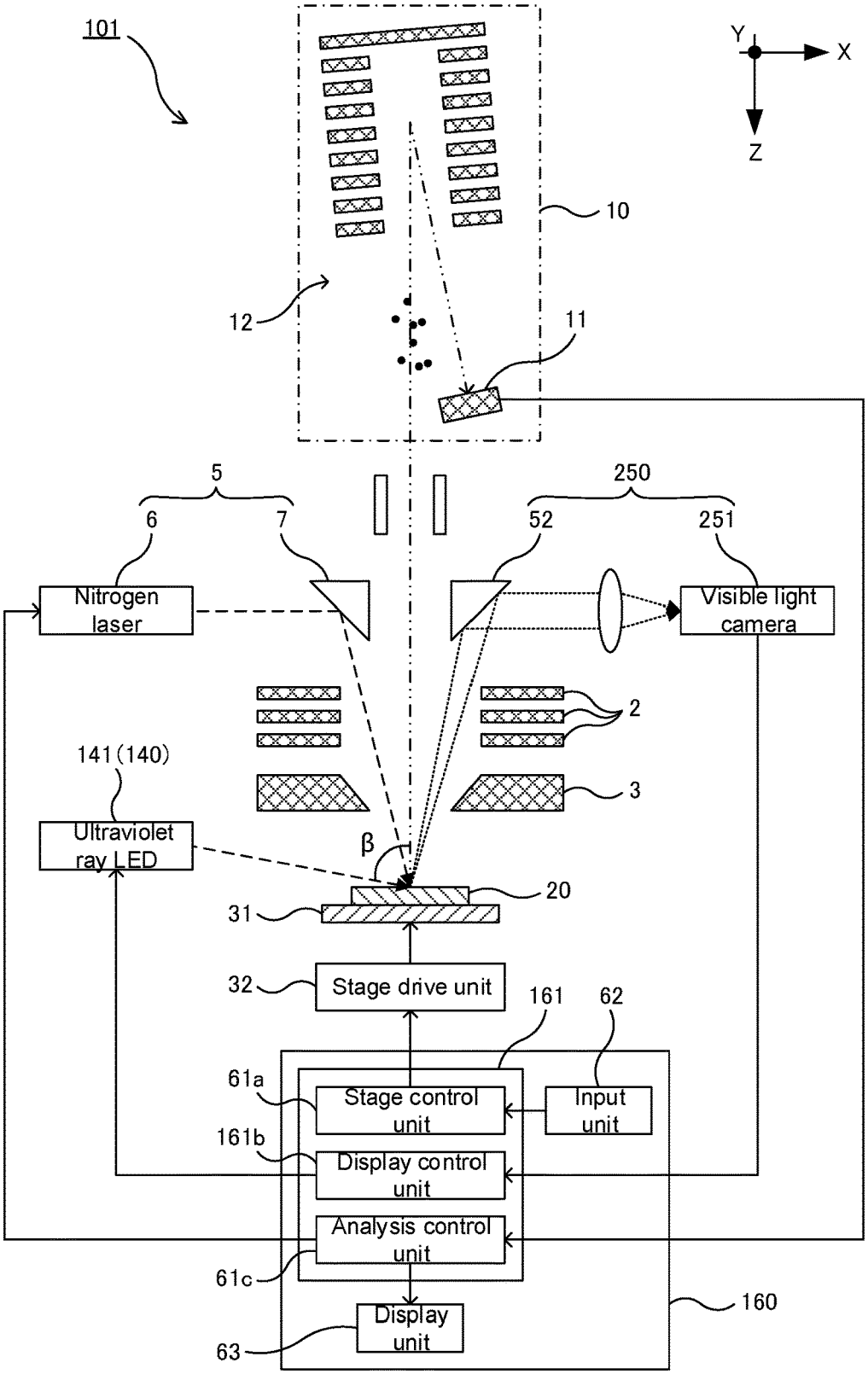
FIG. 3 is a diagram showing a configuration of the second embodiment.
Figure 4:
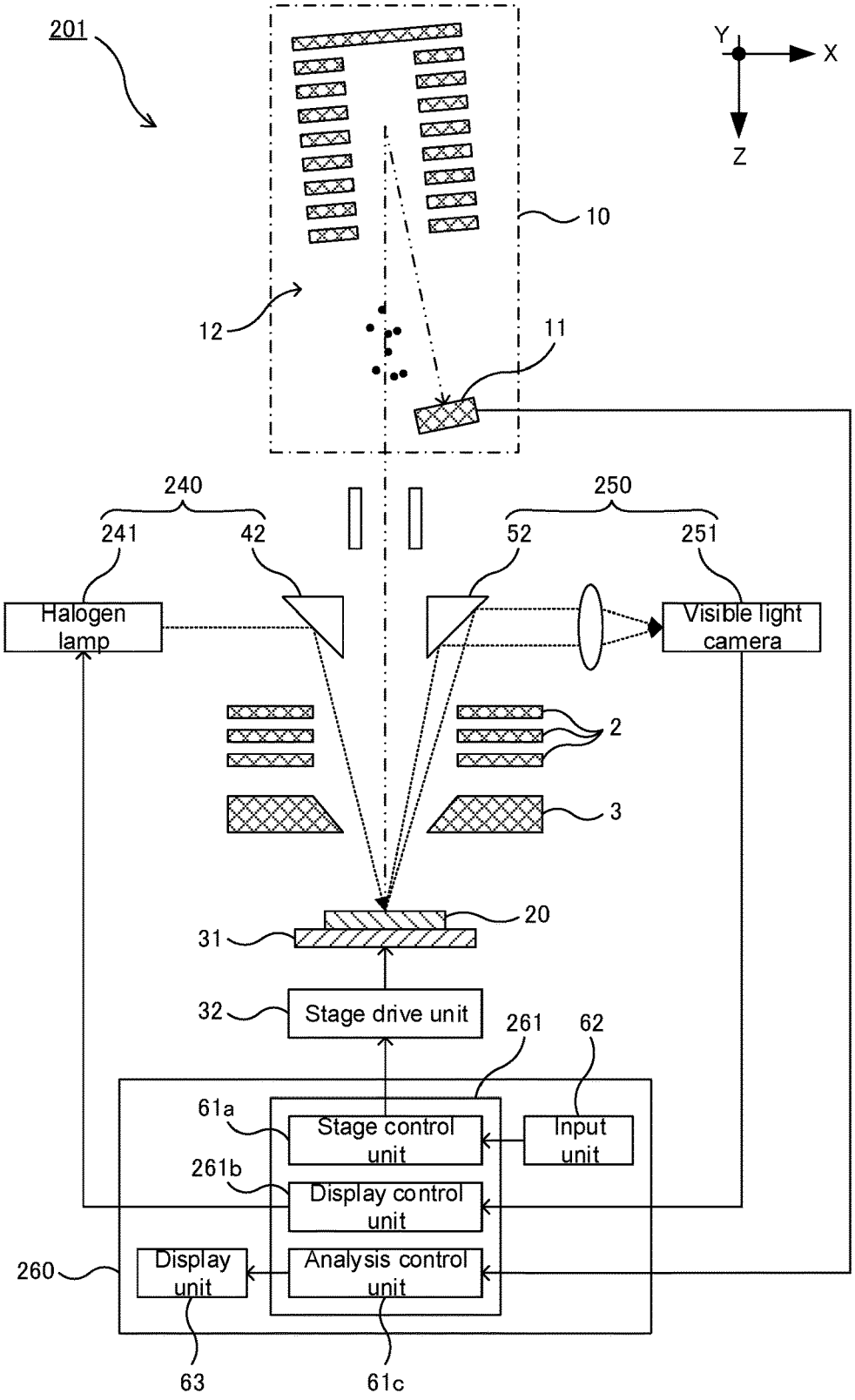
FIG. 4 Prior Art
FIG. 4 is a diagram showing the configuration of an example of a conventional MALDI-TOFMS.
Figure 5:
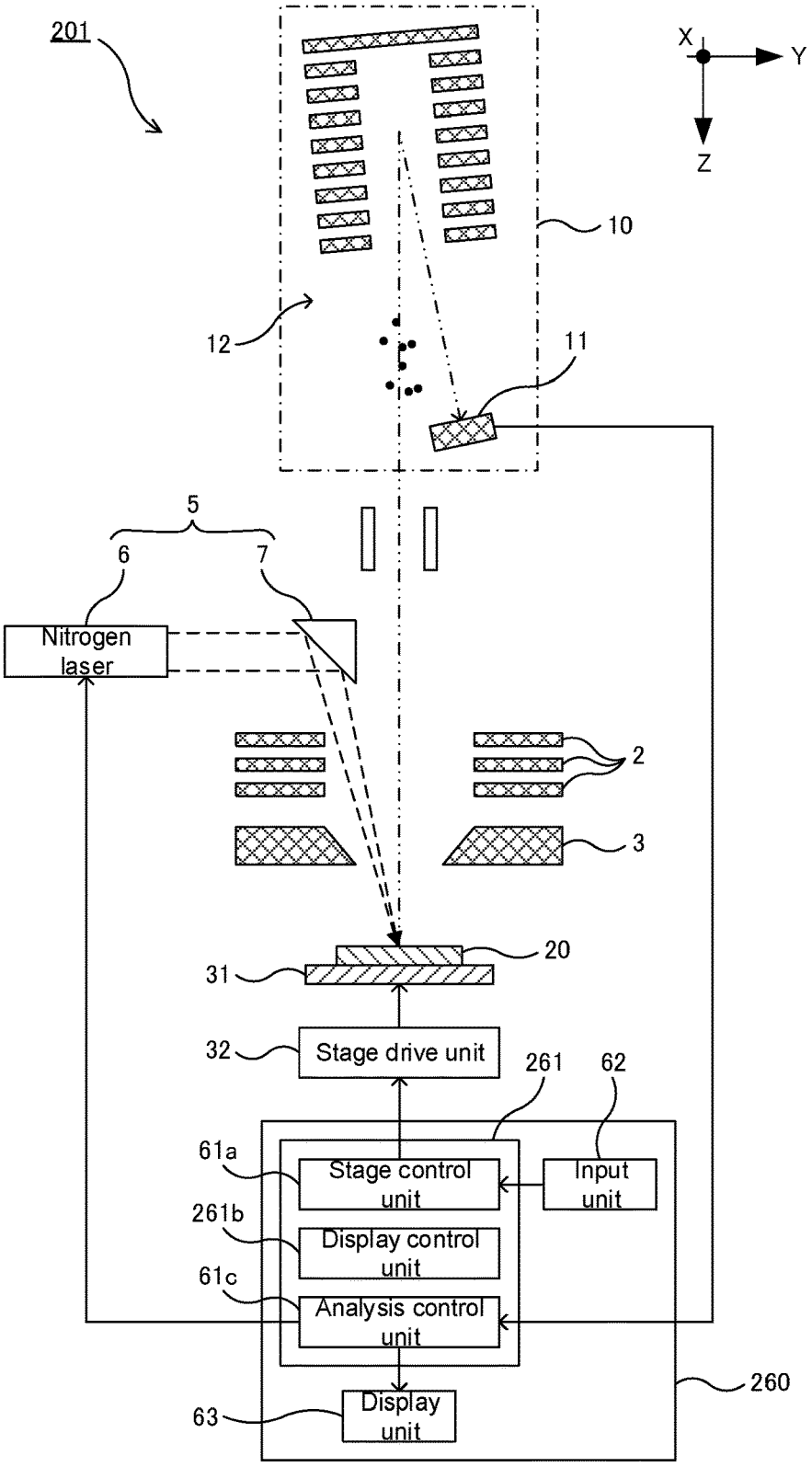
FIG. 5 Prior Art
FIG. 5 is a diagram showing the configuration of another example of a conventional MALDI-TOFMS.

FIG. 3 is a diagram showing the configuration of the MALDI-TOFMS according to the second embodiment of the present invention. Here, the same symbols are attached to the same components as those in the above-described MALDI-TOFMS's 1 and 201, and the descriptions thereof are not repeated.

A MALDI-TOFMS 101 is provided with: a mass spectrometry unit 10; a sample plate 20; a sample stage 31 on which the sample plate 20 is to be mounted; a stage drive unit 32 for moving the sample stage 31; an ultraviolet ray source unit (light source unit) 140 for irradiating the upper surface of the sample plate 20 with ultraviolet rays for observation; an image acquisition device (image acquisition unit) 250 for acquiring an image of the upper surface of the sample plate 20; a laser emitting unit 5 for emitting a laser beam for ionization to the sample; and a computer 160 for controlling the entirety of the MALDI-TOFMS 101.

The ultraviolet ray source unit 140 is provided with an ultraviolet ray LED 141 for emitting ultraviolet rays for observation. Thus, a predetermined range on the upper surface of the sample plate 20 is irradiated with ultraviolet rays emitted from the ultraviolet ray LED 141 in the direction that forms a set angle β relative to the Z direction (vertical direction).

Here, it is preferable for the wavelength range of the ultraviolet rays emitted from the ultraviolet ray source unit 140 to be a wavelength range that includes the wavelength of 337 nm of the laser beam from the nitrogen laser or the wavelength of 355 nm of the laser beam from the solid-state laser. Furthermore, it is preferable for the wavelength at the center of the above-described ultraviolet rays to be close to the wavelength at the center of the light emitted from the laser emitting unit. It is more preferable for the wavelength at the center of the above-described ultraviolet rays to be within +/−20 nm from the wavelength at the center of the light emitted from the laser emitting unit. Furthermore, it is preferable for the above-described set angle β to be 45° or larger (predetermined angle or a larger angle).

The computer 160 is provided with a CPU 161, an input unit 62 and a display unit 63. The functions resulting from the process by the CPU 161 are described by referring to them as units as follows. The CPU 161 has: a stage control unit 61*a* for controlling the stage drive unit 32 on the basis of an input signal from the input unit 62; a display control unit 161*b* for controlling the ultraviolet ray source unit 140 and taking in a visible light image that has been acquired by the image acquisition device 250 so as to display the visible light image on the display unit 63; and an analysis control unit 61*c* for controlling the nitrogen laser 6 and digitizing a sample signal from the ion detector 11 so as to carry out an appropriate data process.

In the MALDI-TOFMS 101, an operator drips a sample solution gained by mixing DHB or CHCA with a substance to be analyzed into wells on the upper surface of the sample plate 20 and dries the sample solution so as to arrange a sample. Next, the sample plate 20 is placed on the sample stage 31, and after that, the sample stage 31 is moved to find a location that seems to be appropriate for ionization by using the input unit 62 while observing the visible light image before the start of the analysis. Thus, the sample is positioned on the upper surface of the sample plate 20 so as to be located within a range irradiated with a laser beam. At this time, ultraviolet rays that are absorbed by the matrix are emitted as visible light, and thus, the place where the matrix is distributed in the visible light image looks brighter, and therefore, the distribution of the matrix (crystal) can be observed precisely.

3. Other Embodiments (1) Though the MALDI-TOFMS's 1 and 101 are illustrated in the above-described embodiments, the present invention provides a matrix observation device for finding a place to be irradiated with a laser beam that provides high efficiency in ionization, and thus can be applied to analyzers having a MALDI ion source in general. In addition, the present invention can be applied to either vacuum MALDI or atmospheric pressure MALDI.

(2) Though the MALDI-TOFMS's 1 and 101 are illustrated to have a configuration that is provided with a laser emitting unit 5 having a nitrogen laser 6 and an ultraviolet ray source unit 40 or 140, the configuration may be provided with a laser emitting unit having an IR (infrared) laser for emitting infrared rays for ionization and an infrared ray source unit for emitting infrared rays for observation.

At this time, a sample solution that is gained by mixing a matrix of a substance having an absorbance band in an infrared region with a substance to be analyzed is dripped and dried in order to arrange a sample. In the case where urea, DHB, succinic acid, sinapic acid or the like is used as a matrix, for example, the state of ionization differs depending on the location that is irradiated with infrared rays, and therefore, the present invention is particularly effective.

INDUSTRIAL APPLICABILITY

The present invention can be appropriately applied to a MALDI mass spectrometer.

REFERENCE SIGNS LIST

1 MALDI-TOFMS (MALDI mass spectrometer)
20 sample plate

31 sample stage
40 ultraviolet ray source unit (light source unit)
50 image acquisition device (image acquisition unit)

What is claimed is:

1. A matrix assisted laser desorption ionization (MALDI) mass spectrometer for analyzing a sample containing a matrix that absorbs light having a particular wavelength rage, comprising:

a stage on which a sample plate on which a sample is to be arranged is to be placed;

a first light source unit that emits light for observing a distribution of the matrix in the sample, the first light source unit positioned to direct light to a region on the sample plate on which the sample is arranged; and an image acquisition unit for detecting light from said sample plate to generate the distribution of the matrix in the sample;

a second light source unit that emits laser light for being absorbed by the matrix in the sample, the laser light being within said particular wavelength range; and a mass spectrometry unit for carrying out mass spectrometry on a gasified or ionized sample that has been emitted from said sample irradiated with said laser beam, wherein a wavelength range of the light that is emitted from said first light source unit overlaps said particular wavelength of said laser light from the second light source unit.

2. The matrix assisted laser desorption ionization (MALDI) mass spectrometer according to claim 1, wherein said particular wavelength range is an ultraviolet range or an infrared range.

3. The matrix assisted laser desorption ionization (MALDI) mass spectrometer according to claim 2, wherein said first light source unit emits ultraviolet rays or infrared rays in the direction that forms a predetermined angle relative to the vertical direction, and said image acquisition unit is an ultraviolet ray camera or an infrared ray camera for detecting the ultraviolet rays or infrared rays reflected from an upper surface of said sample plate so as to create an optical image.

4. The matrix assisted laser desorption ionization (MALDI) mass spectrometer according to claim 2, wherein said first light source unit emits ultraviolet rays or infrared rays in the direction that forms a predetermined angle relative to the vertical direction, and said image acquisition unit is a visible light camera for detecting the visible light that has been emitted from the plurality of areas for placement of sample arranged on an upper surface of said sample plate so as to create an optical image.

5. The matrix assisted laser desorption ionization (MALDI) mass spectrometer according to claim 1, wherein said matrix has an absorbance band in an ultraviolet or infrared region.

6. The matrix assisted laser desorption ionization (MALDI) mass spectrometer according to claim 1, wherein a number of samples are arranged on an upper surface of said sample plate.

7. The matrix assisted laser desorption ionization (MALDI) mass spectrometer of claim 1, wherein the sample plate is arranged on the stage, and wherein the sample plate comprises the sample having the matrix which is selected from DHB (2,5-dihydroxybenzolate) and CHCA (alpha-cyano-4-hydroxycinnamate).

8. The matrix assisted laser desorption ionization (MALDI) mass spectrometer of claim 1, wherein the first light source unit is a visible light source that provides visible light onto the sample.

9. The matrix assisted laser desorption ionization (MALDI) mass spectrometer of claim 8, where the image acquisition unit is a visible light camera for acquiring a visible light image.

10. The matrix assisted laser desorption ionization (MALDI) mass spectrometer of claim 9, wherein the second light source unit is a laser emission unit emitting ultraviolet rays.

11. The matrix assisted laser desorption ionization (MALDI) mass spectrometer of claim 10, wherein the laser emission unit is a nitrogen laser emitting at a wavelength of 337 nm or a or solid state laser emitting at a wavelength of 355 nm.

12. The matrix assisted laser desorption ionization (MALDI) mass spectrometer of claim 8, wherein the first light source unit is a halogen lamp.

13. The matrix assisted laser desorption ionization (MALDI) mass spectrometer of claim 10, wherein the matrix absorbs UV light from the laser emission unit and emits visible light detectable by the visible light camera.

14. The matrix assisted laser desorption ionization (MALDI) mass spectrometer of claim 1, wherein the first light source unit is an ultraviolet light source that provides ultraviolet light onto the sample, and wherein the ultraviolet light source unit provides a range of wavelengths.

15. The matrix assisted laser desorption ionization (MALDI) mass spectrometer of claim 14, wherein the ultraviolet light source is an LED light source.

16. The matrix assisted laser desorption ionization (MALDI) mass spectrometer of claim 14, wherein a wavelength at the center of the range of wavelengths of the ultraviolet rays emitted from the first light source unit is within +/−20 nm from the wavelength at the center of said particular wavelength range emitted by the second light source unit, and wherein the second light source unit is a laser emitting unit emitting a laser beam.

17. The matrix assisted laser desorption ionization (MALDI) mass spectrometer of claim 14, wherein the image acquisition unit is an ultraviolet ray camera and where areas on the matrix that absorb ultraviolet rays appear dark compared to other areas.

18. A matrix assisted laser desorption ionization (MALDI) mass spectrometer, comprising:

a stage on which a sample plate is provided, the sample plate having a plurality of areas on an upper surface of the sample plate for the placement of samples to be analyzed;

a first light source unit that emits a light for observation with which said sample plate is irradiated, wherein the first light source is positioned so as to direct the first light onto the plurality of areas for placement of samples on the upper surface of the sample plate, the first light being emitted in said particular wavelength range; and an image acquisition unit for detecting first light from said sample plate so as to create an optical image for identifying a particular portion of the plurality of areas to be irradiated with a second light, a second light source unit that comprises a laser and that emits a second light for being directed at an identified particular portion and where the second light is capable of being absorbed by a matrix at said particular portion, the second light being laser light in said particular wavelength range and overlapping with a wavelength of the first light; and a mass spectrometry unit for carrying out mass spectrometry on a gasified or ionized sample that has been emitted due to irradiation of the matrix in said particular portion with said laser.

19. The matrix assisted laser desorption ionization (MALDI) mass spectrometer of claim 18, wherein the plurality of areas on an upper surface of the sample plate for the placement of samples to be analyzed are a plurality of wells formed in an array on the surface of the sample plate.

20. The matrix assisted laser desorption ionization (MALDI) mass spectrometer of claim 19, wherein the sample plate is a conductive metal sample plate, and wherein the plurality of wells comprise dried samples which have crystals of matrix and sample.

* * * * *